US005184429A

United States Patent [19]

Parsons

[11] Patent Number: 5,184,429

[45] Date of Patent: Feb. 9, 1993

[54] SURFACE GROOVING MACHINE

[76] Inventor: Keith A. Parsons, 2611 South Tecumseh Rd., Springfield, Ohio 45502

[21] Appl. No.: 650,586

[22] Filed: Feb. 5, 1991

[51] Int. Cl.[5] ..... B24B 7/18

[52] U.S. Cl. ..... 51/177; 51/209 R; 299/41

[58] Field of Search ..... 51/174, 177, 170 T, 51/170 R, 209 R, 258; 299/3 C, 39, 41, 88, 89

[56] References Cited

U.S. PATENT DOCUMENTS

| | | | |
|---|---|---|---|
| 972,533 | 10/1910 | Heusermann | 51/177 |
| 1,932,319 | 5/1932 | Myers | 51/177 |
| 2,316,886 | 4/1943 | Pascucci | 51/177 |
| 2,702,569 | 2/1955 | Yelle | 144/136 |
| 2,712,841 | 7/1955 | Simmons et al. | 144/119 |
| 2,754,861 | 3/1954 | Faurel et al. | 144/133 |
| 3,517,466 | 6/1970 | Bouvier | 51/358 |
| 3,934,377 | 1/1976 | Tertinek | 51/177 |
| 4,300,522 | 10/1981 | Henry et al. | 125/11 |
| 4,702,223 | 10/1987 | Swan | 125/3 |
| 4,822,757 | 4/1989 | Sadamori | 437/249 |

*Primary Examiner*—Roscoe V. Parker
*Attorney, Agent, or Firm*—Ralph L. Marzocco

[57] ABSTRACT

A vehicle has affixed a gear rack mast for mounting a modified core driller adapted to accommodate a flexible coupling for driving a texturing tool for grooving or scoring a plurality of monolithic blocks to an even depth regardless of their levelness with respect to one another. The texturing tool has a plurality of concentric grooves in which are affixed a plurality of abrasive containing arcuate segments. A sensing system is provided for maintaining depth of groove.

8 Claims, 3 Drawing Sheets

SURFACE GROOVING MACHINE

BACKGROUND OF THE INVENTION

1. Field of the Invention

The present invention generally relates to surface grooving machines. More particularly, the invention relates to a surface grooving machine for grooving or scoring the finished face of monolithic blocks.

2. Description of the Prior Art

It is indisputable that the finished face of monolithic substances such as granite, marble, ceramic, and the like when exposed but to a thin film of a lubricant such as water, oil, or fat becomes dangerously slippery. A person can hardly walk without slipping or even falling-down on floors of monlithic substances in restaurants, hospitals, and like establishment that are subjected to a lubricant. However, there is presently lacking satisfactory mechanical means for overcoming the problems presented by a slippery surface of an existing floor such as those in a restaurant kitchen with smooth ceramic floor tiles.

Grinding machines for smoothing surfaces or grooving machines for removing material from surfaces have been disclosed and utilized. Representative of the prior art are the machines or devices described in U.S. Pat. Nos. 1,932,319 (Myers), 2,702,569 (Yelle), 2,712,841 (Simmons et al), 2,754,861 (Faurel et al), 3,517,466 (Bouvier), 4,300,522 (Henry et al), 4,702,223 (Swan), 4,822,757 (Sadamori).

The patents issued to Swan, Henry et al, Bouvier, Simmons et al, and Myers generally involve grinding machines, while the patents issued to Sadamori, Faurel et al, and Yelle generally involve grooving machines. Summarily, Henry et al teach a rotating tool with carbide bits on its face for dressing a surface. Myers, Swan, and Bouvier teach rotating tools that have spaced diamond type bits that could be used to cut or to groove a surface. While Yelle, Simmons et al, and Faurel et al teach vertical axis tools with a cutting face to score or to groove a surface.

While many of the structural arrangements of the prior art for smoothing or removing material from the surface of substances appear to function reasonably well and generally achieve the objectives for which they were designed, most seem to embody shortcomings which make them less than an exemplary design. For example, existing grooving machines with vertical axes normal to a floor surface cannot precisely groove floor tiles because they are set in grout not exactly level but at somewhat of an angle with respect to one another thereby causing the higher surface of the tile to be grooved at a greater depth than the lower surface of the tile. Additionally, existing grooving machines lack the means for assuring a constant depth of groove over a floor surface. Consequently, a need still exists for a different approach to design a grooving machine capable of grooving uneven ceramic floor tiles and other monolithic substances to a predetermined depth even when the surfaces of such substances are not level with respect to one another.

SUMMARY OF THE INVENTION

The present invention is directed to providing a surface grooving machine capable of grooving or scoring the entire surface area of ceramic floor tiles and the like to a predetermined depth even when the surface of the floor is not exactly planar.

The surface grooving machine of the present invention includes a vehicle to which is affixed a gear rack mast for mounting a modified core driller. The modified core driller is adapted to accommodate a flexible drive coupling to drive a texturing tool for grooving or scoring a ceramic tile floor and the like. The face of the texturing tool has a number of circular grooves in which a number of diamond segments are affixed. Incorporated into the grooving machine is a precision measuring device for maintaining a predetermined depth of groove in the floor surface regardless of the levelness of the floor surface.

The primary advantage of the surface grooving machine is the minimization of the slipperiness of a smooth floor of monolithic blocks such as ceramic tile by grooving the finished face of the tile to a predetermined depth regardless of the levelness of the floor. This and other advantages and attainments of the present invention will become apparent to those skilled in the art upon a reading of the detailed description when taken in conjunction with the drawings wherein there is shown and described an illustrative embodiment of the invention.

BRIEF DESCRIPTION OF THE DRAWINGS

For a further understanding of the nature and object of the invention, reference should be had to the detailed description of the exemplary embodiment taken in connection with the appended drawings in which.

DETAILED DESCRIPTION OF THE INVENTION

Figure 1:
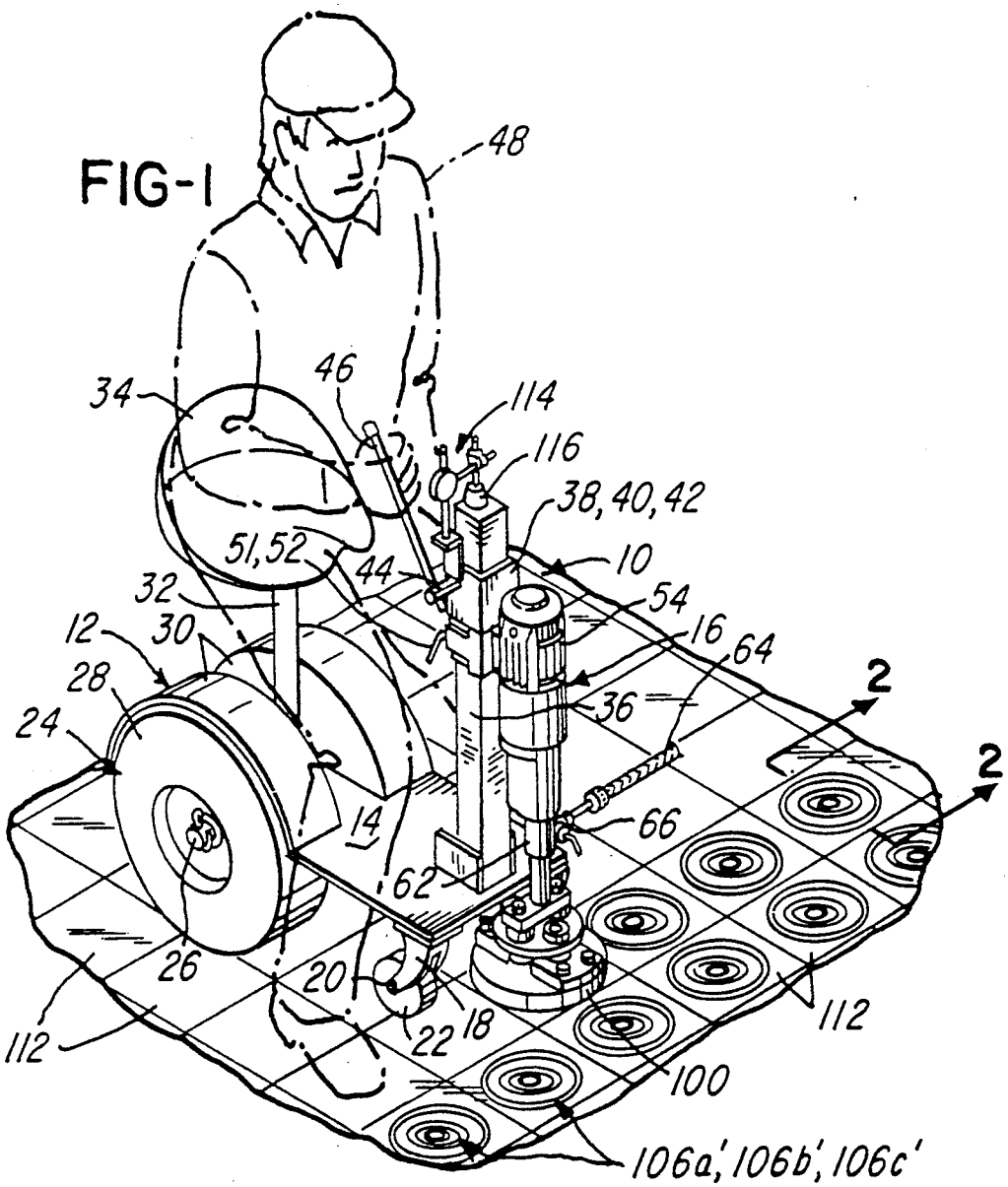
FIG. 1 is a perspective view of a phantomly outlined operator in the process of scoring the finished surface of a monolithic block of a floor with the surface grooving machine of this invention.
Figure 2:
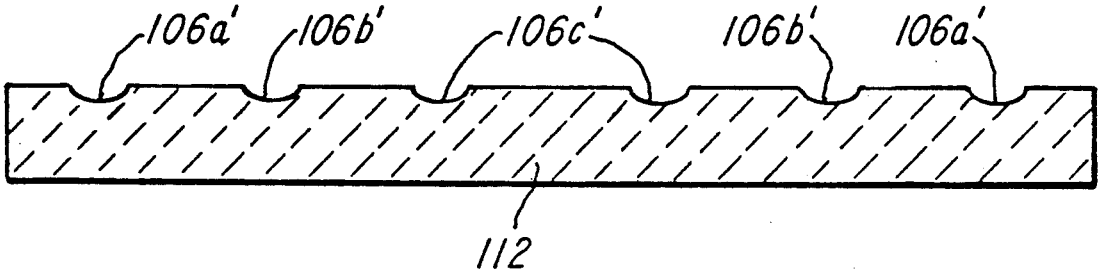
FIG. 2 is an elevational view of a monolithic block which has been scored by the surface grooving machine of this invention as seen along line 2—2 of FIG. 1.

In the following description, like reference characters designate like or corresponding parts throughout the several views of the drawings. Also in the following description, it is to be understood that such terms as "forward", "rearward", "left", "right", "upwardly", "downwardly", and the like, are words of convenience and are not to be construed as limiting terms.

Figure 3:
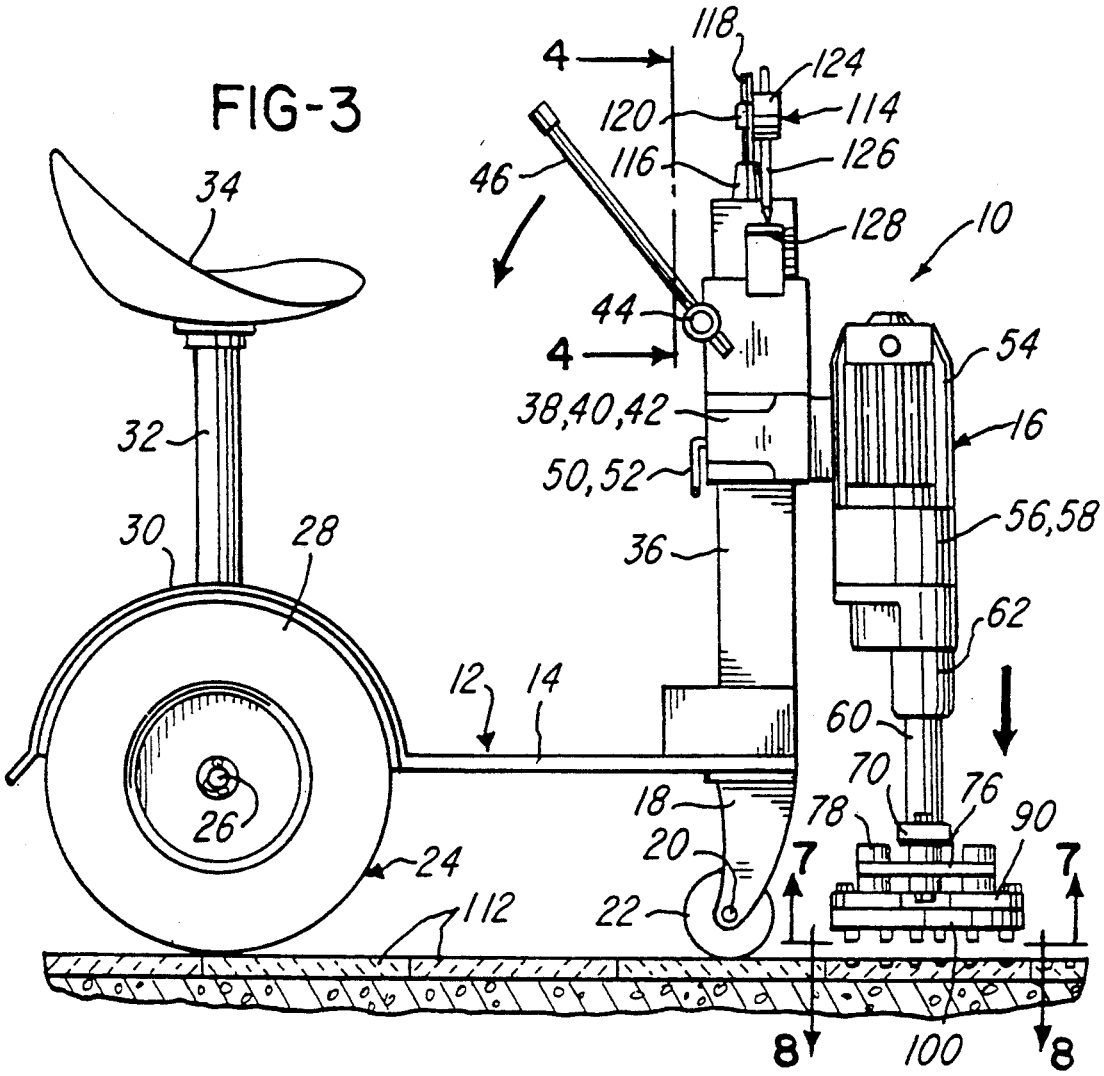
FIG. 3 is a side elevational view of the surface grooving machine of this invention.

Referring now to the drawings, and particularly to FIGS. 1 and 3, there is illustrated a surface grooving machine, generally designated by the numeral 10 and constituting the preferred embodiment of the present invention. In its preferred embodiment, surface grooving machine 10 comprises a multi-wheeled vehicle 12 having a vehicle framework 14 which supports a modified core driller 16.

Toward the front end of multi-wheeled vehicle 12 a pair of generally U-shaped assemblies 18 (the left assembly not being shown) are turnably affixed to the underside of vehicle framework 14. Each U-shaped assembly 18 has a front axle 20 for a rotatable front wheel 22. Toward the rear end of vehicle framework 14 a pair of rear wheels 24 (the left rear wheel not being shown) are rotatably affixed to a rear axle 26 which in turn is affixed to the underside of vehicle framework 14. Mounted to each rear wheel 24 is a vehicle tire 28 (the left rear vehicle tire not being shown). A pair of rear fenders 30 affixed to the upper side of vehicle framework 14 covers the uppermost portion of vehicle tires 28. Centered between rear fenders 30 and affixed to vehicle framework 14 is a seat post 32 to which is mounted an operator seat 34. Perpendicularly affixed to the upper and forward portion of vehicle framework 14 is an elongated, parallelepiped-shaped, base mounted mast 36, elongated mast 36 having an elongated gear rack 38 (not shown) affixed to a side thereof.

A mast carriage 40, which is generally an open-ended, box-like structure that slidably envelops elongated mast 36, cooperates with elongated gear rack 38 (not shown) for travel upwardly and downwardly elongated gear rack 38 (not shown) and perforce elongated mast 36. Movement of mast carriage 40 is accomplished with a carriage gear 42 (not shown) rotatably intermeshing with elongated gear rack 38 (not shown), carriage gear 42 (not shown) being affixed to a carriage shaft 44 that is rotatably affixed to mast carriage 40. One end portion of carriage shaft 44, which extends somewhat beyond a side wall of mast carriage 40, is connected to a rod-like feed handle 46 so that a downwardly or an upwardly turn of feed handle 46 by a machine operator 48 (shown in phantom) causes mast carriage 40 to travel downwardly or upwardly elongated mast 36. Mast carriage 40 is lockable at a predetermined vertical position by a carriage locking means 50 (not shown) provided with a carriage locking handle 52. Thus, mast carriage 40 can travel upwardly and downwardly elongated mast 36 to a predetermined vertical position and be locked at that position.

Affixed to the forward portion of mast carriage 40 is a core drill motor 54 which is rotatably connected with a set of gears 56 (not shown) housed in a gear box 58 for providing variable speed to a hollow drill spindle 60 which is partially housed in a reservoir-chamber 62 for supplying coolant-lubricant such as water to the hollow portion of drill spindle 60. The coolant-lubricant is supplied to reservoir-chamber 62 by means of a flexible tubing 64 connected to a coolant-lubricant source (not shown) through a metering valve 66 that is connected to reservoir-chamber 62.

Figure 6:
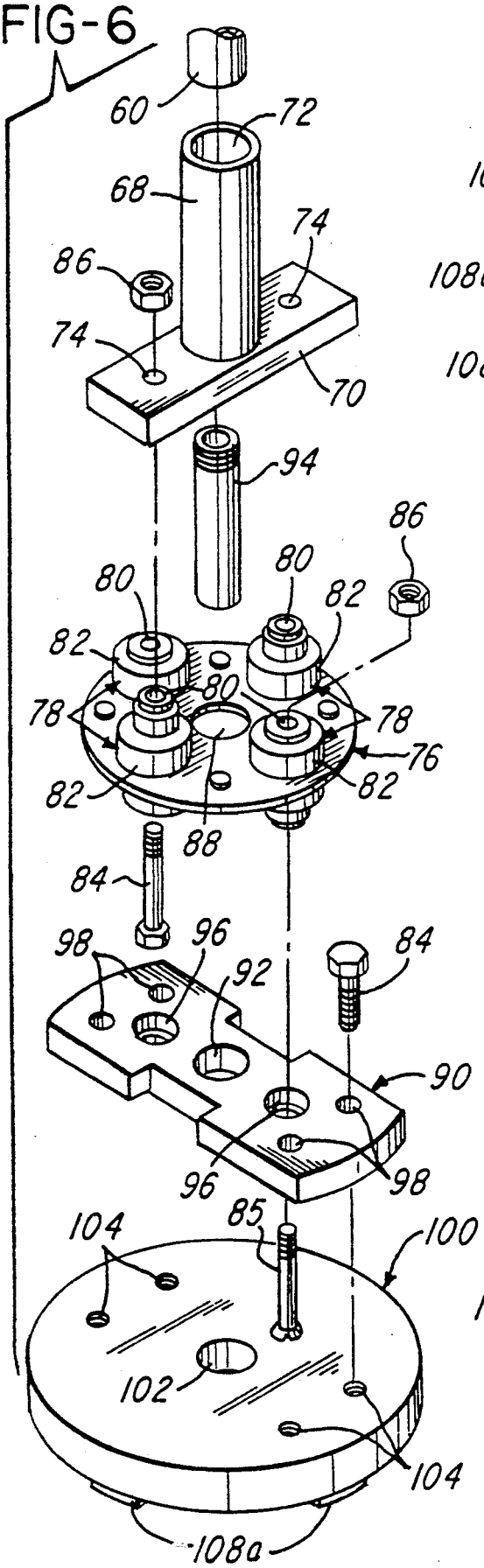
FIG. 6 is an exploded perspective view of a coupler and a cutting disk assembly of the surface grooving machine of this invention.

As is also shown in the exploded illustration of FIG. 6, a hollow cylindrical extension 68 at one end is rotatably affixed to core drill motor 54 and at the other end is centrally affixed to a rectangular top plate 70 provided with a top plate central passageway 72 and a pair of diametrically opposed top plate bores 74 therethrough.

In order to compensate for misalignment and to provide the torsional flexibility required to groove or score the entire surface area of ceramic floor tiles and the like to a predetermined depth even when the surface of the floor is not exactly planar, a circular middle plate 76 having affixed thereto a plurality of Morse Morflex® couplings 78 is affixed to top plate 70. Proprietary couplings 78, which comprise resilient, noncold-flow neoprene biscuits (not shown) with a biscuit central bore 80 encased in a biscuit housing 82, are manufactured by the Morse Company, Florence, Ky., USA. Middle plate 76 is secured to top plate 70 by having the unthreaded portion of the shaft of a hexagonal-shaped-head bolt 84 being disposed within biscuit central bore 80 of one of the first pair of diametrically opposed proprietary couplings 78 and one of a pair of spatially aligned, diametrically opposed top plate bores 74 and having the threaded end portion of the shaft of hexagonal-shaped-head bolt 84 being fastened to a hexagonal-shaped nut 86. Middle plate 76 has a central passageway 88 in spatial alignment with top plate central passageway 72.

A rectangular bottom plate 90, whose plane is parallel to the plane of middle plate 76 and top plate 70, and whose planar orientation is at a 90° angle with respect to the planar orientation of top plate 70, is secured to middle plate 76 by the unthreaded portion of the shaft of a tapered-head bolt 85 being disposed within biscuit central bore 80 of one of the second pair of diametrically opposed proprietary couplings 78. Bottom plate 90 has a central passageway 92 in spatial alignment with top plate central passageway 72 and with middle plate central passageway 88 for providing passage for a collant-lubricant annular pipe 94. Additionally, bottom plate 90 has a pair of internally shouldered bores 96 in a longitudinal line with bottom plate central passageway 92 and has a double pair of peripheral bores 98 diametrially opposed to one another. Each of the longer sides of bottom plate 90 is slotted in proximity of bottom plate central passageway 92 to provide space for the lower portion of two of the diametrically opposed proprietary couplings 78. The lower portion of the other pair of diametrically opposed proprietary couplings 78 are disposed within internally shouldered bores 96. As is shown in FIG. 6, the vertical orientation of one pair of diametrically opposed proprietary couplings 78 differs 180° with respect to the vertical orientation of the other pair of diametrically opposed proprietary couplings 78. Bottom plate 90 is secured to middle plate 76 by disposing the unthreaded portion of the shaft of tapered-head bolt 85 within biscuit central bore 80 of one of the pair of diametrically opposed proprietary couplings 78 of internally shouldered bores 96 and fastening the threaded portion of the shaft of tapered-head bolt 85 to hexagonal-shaped nut 86.

A texturing tool or grooving disk 100 has a central passageway 102 in spatial alignment with top plate central passageway 72, with middle plate central passageway 88, and with bottom plate central passageway 92 for providing passage for coolant-lubricant annular pipe 94. The top side of grooving disk 100 has a double pair of threaded openings 104 diametrically opposed to one another and in spatial alignment with the double pair of peripheral bores 98 of bottom plate 90. Grooving disk 100 is secured to bottom plate 90 by the unthreaded portion of the shaft of hexagonal-shaped-head bolt 84 being disposed within peripheral bore 98 of bottom plate 90 and having the threaded end portion of the shaft of hexagonal-shaped-head bolt 84 being screwed into threaded openings 104 of grooving disk 100.

Figure 7:
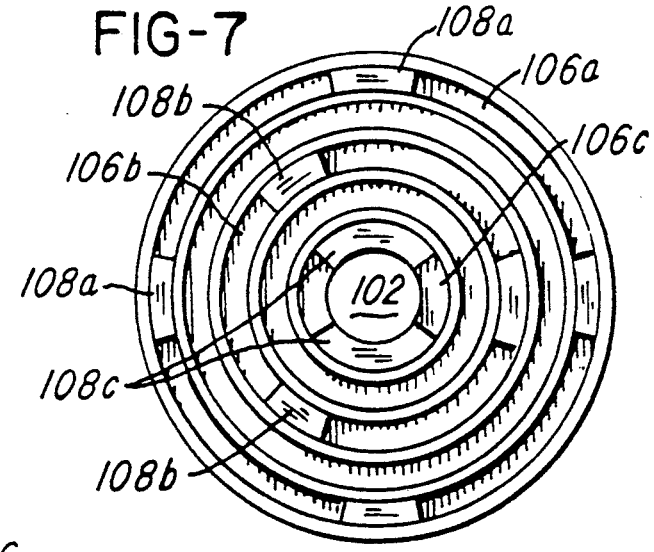
FIG. 7 is a plan view of the cutting disk of the surface grooving machine of this invention as seen along line 7—7 of FIG. 3.

As is shown in FIG. 7, the bottom side of grooving disk 100 has a plurality of concentric grooves 106 a, b, and c in which a plurality of arcuate segments 108 a, b, and c of an abrasive substance 110 are affixed. For example, four arcuate segments 108*a* are affixed in outer groove 106*a*, three arcuate segments 108*b* are affixed in middle groove 106*b*, and two arcuate segments 108*c* are affixed in inner groove 106*c*. Abrasive substance 110 preferrably comprises a mixture of synthetic diamonds and a bonding agent, such as bronze, oven fired in molds whose configurations are equivalent to the predetermined configurations of concentric grooves 106 a, b, and c and whose thickness is somewhat dependent upon the depth of grooving or scoring desired. Silver soldering is the preferred method of affixing arcuate segments 108 a, b, and c in concentric grooves 106 a, b, and c.

Figure 8:
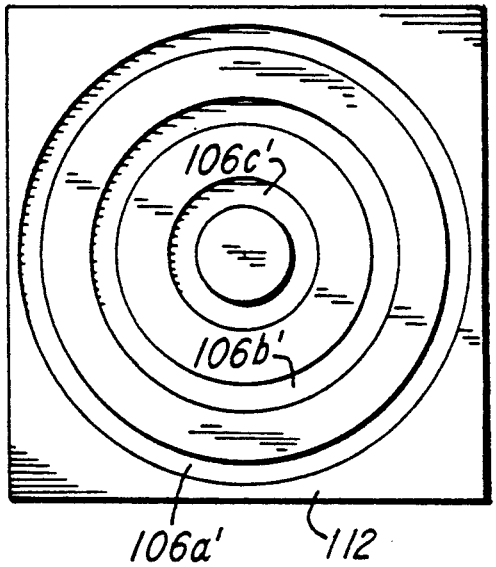
FIG. 8 is a plan view of a grooved monolithic block produced by the surface grooving machine of this invention as seen along line 8—8 of FIG. 3.
Figure 9:
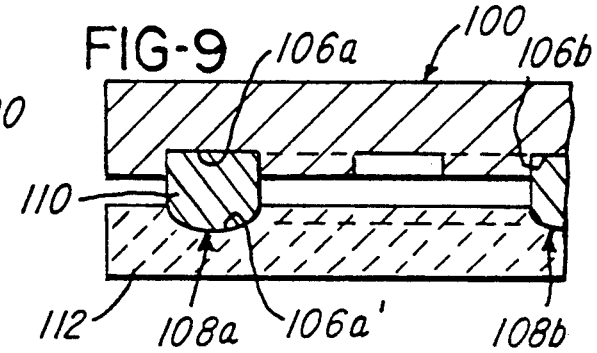
FIG. 9 is a fragmentary cross-sectional view of the cutting disk of the surface grooving machine of this invention in the process of grooving a monolithic block.

As is shown in FIG. 8, in order to circularly groove a ceramic tile 112 and the like to a uniform depth to produce a plurality of concentric grooves 106 a', b', and c', coolant-lubricant such as water is used to cool grooving disk 100 to ensure uniform wear of arcuate segments 108 a, b, and c. Coolant-lubricant is provided to the bottom side of grooving disk 100 and to the surface of ceramic tile 112 and the like by annular pipe 94, one end of which is externally threaded and is screwed into internally threaded drill spindle 60. Hollow cylindrical extension 68, top plate central passageway 72, middle plate central passageway 88, bottom plate central passageway 92, and grooving disk central passageway 102 provide a passage for annular pipe 94. The end portion of annular pipe 94 is sufficiently recessed in grooving disk 100 so as to not interfere with any grooving or scoring operation.

Figure 4:
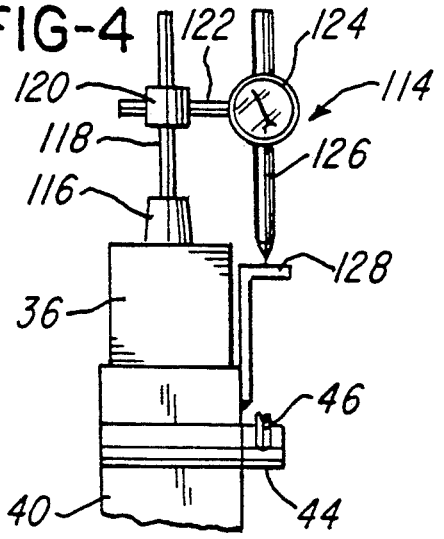
FIG. 4 is a front elevational view of the depth of groove measuring device of the surface grooving machine of this invention as seen along line 4—4 of FIG. 3. The device is set at a predetermined depth when the cutting disk contacts the finished face of a monolithic block.
Figure 5:
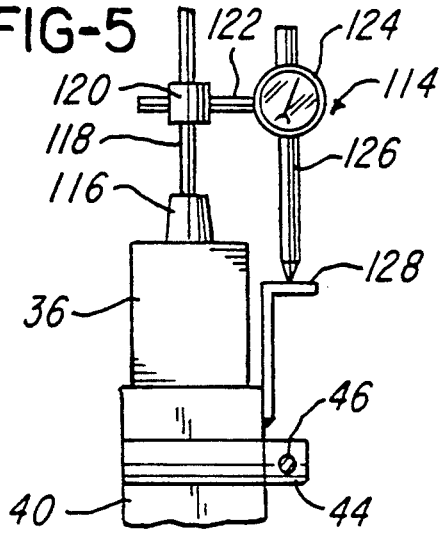
FIG. 5 is a front elevational view of the depth of groove measuring device of the surface grooving machine of this invention. The device reads zero when the cutting disk has grooved the finished face of a monolithic block to a predetermined depth.

In order to circularly groove or score ceramic tile 112 and the like to a predetermined depth, a sensor assembly 114 is provided to indicate when ceramic tile 112 has been grooved or scored to a specific depth. As is shown in the drawings and as is particularly shown in FIGS. 4 and 5, sensor assembly 114 has a pedestal base 116 which is affixed to the top of elongated mast 36 and which supports a vertically oriented pedestal rod 118. Vertically oriented pedestal rod 118 has a vertically movable swivel clamp 120 which accommodates a horizontally oriented indicator rod 122. To indicator rod 122 is affixed a dial indicator 124 having a vertically movable rod-like probe 126 with a conical-shaped end portion.

Permanently affixed to an upper side portion of carriage mast 40 is a horizontally oriented carriage plate 128, the top surface of which is contactable by the conical-shaped end portion of rod-like probe 126. In operation when the arcuate segments 108 a, b, and c contact ceramic tile 112 and the like, dial indicator 124 is set by machine operator 48 (shown in phantom) to a specific depth. During the grooving or scoring process, mast carriage 40 downwardly movement on elongated mast 36 causes modified core driller 16 to groove or score ceramic tile 112 and the like to a specific depth when dial indicator 124 shows a zero reading.

It is thought that the present invention and many of its attendant advantages will be understood from the foregoing description and it will be apparent that various changes may be made in form, construction, and arrangement of the parts thereof without departing from the spirit and scope of the invention or sacrificing all of its material advantages, the form hereinabove described being merely a preferred or exemplary embodiment thereof.

The invention having been described, what I claim is:

1. A movable machine with a texturing tool for grooving or scoring the surface of monolithic blocks of a floor to a predetermined depth regardless of floor planarity, which comprises:

a vehicle having a pair of rotatable and turnable front wheels and a pair of rotatable rear wheels, a pedestal mounted operator seat, and a gear rack mast all affixed to the framework of the vehicle;

a modified core driller slidably mounted to the gear rack mast, said core driller having rotatable driving means and having cooling and lubricating means;

an assembly of flexible couplings to compensate for misalignment of the core driller with respect to the plurality of nonplanar monolithic blocks and to provide the torsional flexiblity required to evenly groove or score the surface of a plurality of nonplanar monolithic blocks, said assembly being rotatably drivable by the driving means of the modified core driller;

a rotatable texturing tool or grooving disk having a plurality of concentric grooves, said texturing tool or grooving disk being rotatably drivable by the assembly of flexible couplings and being communicably connected to the cooling and lubricating means;

a plurality of replaceable abrasive arcuate segments periodically disposed in the concentric grooves of the rotatable texturing tool or grooving disk with the exposed surface of the abrasive arcuate segments projecting beyond the shoulders of the concentric grooves; and a sensor assembly for controlling the depth of grooving or scoring produceable by the abrasive arcuate segments of the texturing tool or grooving disk.

2. The movable machine with texturing tool according to claim 1, wherein coolant-lubricant is supplied to a reservoir-chamber of the core driller by a flexible tubing connected to a coolant-lubricant source through a metering valve.

3. The movable machine with a texturing tool according to claim 1, wherein the assembly of flexible couplings comprises a plurality of Morse Morflex® couplings, manufactured by the Morse Company, Florence, Ky., USA.

4. The movable machine with a texturing tool according to claim 3, wherein the assembly of flexible couplings comprise a plurality of biscuit housing encasing a resilient, noncold-flow neoprene biscuit.

5. The movable machine with a texturing tool according to claim 1, wherein an abrasive substance of the abrasive arcuate segments comprise an oven fired mixture of synthetic diamonds and bronze.

6. The movable machine with a texturing tool according to claim 1, wherein the abrasive arcuate segments are silver soldered in the concentric grooves of the texturing tool or grooving disk.

7. The movable machine with texturing tool according to claim 1, wherein the sensor assembly comprises a pedestal base affixed to the top of the gear rack mast, said pedestal base supporting a vertically oriented pedestal rod with a vertically movable swivel clamp, said swivel clamp accommodating a horizontally oriented indicator rod with a dial indicator, said dial indicator having a vertically movable rod-like probe with a conical-shaped end portion, said rod-like probe being contactable with a horizontally oriented carriage plate affixed to an upper side portion of the carriage mast.

8. A machine with a texturing tool for grooving or scoring the surface of monolithic blocks of a floor to a predetermined depth regardless of floor planarity, which comrpises:

a modified core driller slidably mounted to a base mounted gear rack mast, said core driller having rotatable driving means and having cooling and lubricating means;

an assembly of flexible couplings to compensate for misalignment of the core driller with respect to the plurality of nonplanar monolithic blocks and to provide the torsional flexibility required to evenly groove or score the surface of a plurality of nonplanar monolithic blocks, said assembly being rotatably drivable by the driving means of the modified core driller;

a rotatable texturing tool or grooving disk having a plurality of concentric grooves, said texturing tool or grooving disk being rotatably drivable by the assembly of flexible couplings and being communicably connected to the cooling and lubricating means;

a plurality of replaceable abrasive arcuate segments periodically disposed in the concentric grooves of the rotatable texturing tool or grooving disk with the exposed surface of the abrasive arcuate segments projecting beyond the shoulders of the concentric grooves; and a sensor assembly for controlling the depth of grooving or scoring produceable by the abrasive arcuate segments of the texturing tool or grooving disk.

* * * * *